US012446691B2

(12) United States Patent
Nilsson et al.

(10) Patent No.: US 12,446,691 B2
(45) Date of Patent: Oct. 21, 2025

(54) SUSPENSION SYSTEM FOR STORAGE COMPONENTS

(71) Applicant: Elfa International AB, Västervik (SE)

(72) Inventors: Peter Nilsson, Västervik (SE); Tobias Ringenhag, Västervik (SE)

( * ) Notice: Subject to any disclaimer, the term of this patent is extended or adjusted under 35 U.S.C. 154(b) by 0 days.

(21) Appl. No.: 18/349,926

(22) Filed: Jul. 10, 2023

(65) Prior Publication Data

US 2024/0016293 A1 Jan. 18, 2024

Related U.S. Application Data

(62) Division of application No. 17/246,442, filed on Apr. 30, 2021, now Pat. No. 11,717,085.

(30) Foreign Application Priority Data

Apr. 30, 2020 (SE) ..... 2050497-3
Sep. 16, 2020 (SE) ..... 2051078-0

(51) Int. Cl.
*A47B 96/14* (2006.01)
*A47B 57/42* (2006.01)
*A47F 5/08* (2006.01)

(52) U.S. Cl.
CPC ..... *A47B 96/1441* (2013.01); *A47B 96/1408* (2013.01); *A47B 57/42* (2013.01); *A47F 5/08* (2013.01)

(58) Field of Classification Search
CPC ..... A47B 96/1441; A47B 96/1408; A47B 96/061; A47B 96/067; A47B 96/07; A47B 47/00; A47B 47/022; A47B 57/42; A47F 5/08; A47F 5/0838; A47F 5/0846; A47F 5/0853
See application file for complete search history.

(56) References Cited

U.S. PATENT DOCUMENTS 2,562,290 A 7/1951 Dickerson
2,644,591 A 7/1953 McMahan
2,661,993 A 12/1953 Little
(Continued)

FOREIGN PATENT DOCUMENTS

CA 2737714 A1 10/2012
CN 2648906 Y 10/2004
(Continued)

OTHER PUBLICATIONS

Amendment and Reply dated Mar. 16, 2021 in Swedish Patent application No. 2050499-9 of Elfa International AB. 7 pages.
(Continued)

*Primary Examiner* — Devin K Barnett
(74) *Attorney, Agent, or Firm* — Hubbard Law, PLLC; Marc A. Hubbard

(57) ABSTRACT

The present disclosure relates to a suspension system with a rear rail, configured to be arranged on a wall or the like, and a hang standard with rear leg portions comprising suspension slots arranged in each of the leg portions and being configured to connect with the lower flange of the rear rail. The rear rail further comprises an upper flange, and each of the hang standard leg portions comprise a mounting slot adapted to connect with the upper flange of the rear rail. The upper and lower flanges at least partially extend in different directions.

4 Claims, 4 Drawing Sheets

(56) References Cited

U.S. PATENT DOCUMENTS 2,919,033 A 12/1959 Lundqvist
2,921,693 A 1/1960 Mclean
3,278,248 A 10/1966 Torok
3,325,129 A 6/1967 Tinfow
3,331,514 A 7/1967 Bruynzeel
3,396,499 A 8/1968 Biffani
3,510,010 A 5/1970 Gasner
3,563,182 A 2/1971 MacFarlane
3,592,493 A 7/1971 Goose
3,601,347 A 8/1971 Attwood
3,645,486 A 2/1972 Ferdinand
3,671,061 A 6/1972 Dawdy
3,765,344 A 10/1973 Ferdinand
3,771,466 A 11/1973 Ferdinand
D230,116 S 1/1974 Beams
3,828,937 A 8/1974 Nash
3,848,844 A 11/1974 Barrett
3,865,336 A 2/1975 Robertson
3,993,002 A 11/1976 Stroh
4,069,638 A 1/1978 Hasselqvist
4,285,484 A 8/1981 Follows
4,312,086 A 1/1982 Bianco
4,411,400 A 10/1983 Everett
4,711,420 A 12/1987 Cowler
4,735,470 A 4/1988 Falk
4,816,205 A 3/1989 Remy
4,944,566 A 7/1990 Carper
4,995,323 A 2/1991 Kellems
5,004,198 A 4/1991 Jager
5,004,201 A 4/1991 Bessinger
5,007,608 A 4/1991 Carroll, Jr.
5,014,902 A 5/1991 Heimendinger
5,074,009 A 12/1991 Simonton
5,110,080 A * 5/1992 Rieman ..... A47B 96/1408
248/225.11
D327,839 S 7/1992 Stumpf
5,135,194 A 8/1992 Laughon
D342,015 S 12/1993 Andrejew
5,348,385 A 9/1994 Berg
5,377,851 A 1/1995 Asano
5,472,103 A 12/1995 Merl
5,509,541 A 4/1996 Merl
5,531,416 A 7/1996 Remmers
5,551,772 A 9/1996 Keffer
5,638,644 A * 6/1997 Bastian ..... B01L 9/02
52/656.1
5,794,903 A 8/1998 Peterson, II
D411,738 S 6/1999 Raasch
6,109,461 A 8/2000 Kluge
6,112,913 A 9/2000 Rindoks
6,185,887 B1 2/2001 Strassle
6,195,953 B1 3/2001 Gitter
6,363,643 B1 4/2002 Padiak
6,428,128 B1 8/2002 Henriott
6,497,185 B1 12/2002 Barrett
6,592,194 B2 7/2003 Lininger
D479,932 S 9/2003 Clucas
D490,697 S 6/2004 Runnalls
6,932,225 B2 8/2005 Rowe
7,086,543 B2 8/2006 Remmers
7,086,544 B1 * 8/2006 Doench ..... A47B 96/028
248/222.51
D529,254 S 9/2006 Huguet
7,188,740 B2 3/2007 Marchetta
D550,540 S 9/2007 Nawrocki
D572,125 S 7/2008 Nilsson
7,392,911 B2 7/2008 Stitchick
7,427,053 B2 9/2008 Nawrocki
D577,936 S 10/2008 Held
D592,945 S 5/2009 Mahan
D649,026 S 11/2011 Kong
D649,027 S 11/2011 Pensi
8,087,521 B2 1/2012 Schwartzkopf
8,210,368 B2 7/2012 Schwartzkopf
D674,626 S 1/2013 Gasser
D680,361 S 4/2013 Zobel
D684,402 S 6/2013 Gasser
D684,403 S 6/2013 Gasser
8,684,195 B1 4/2014 Caruso
D722,831 S 2/2015 Tuang
D732,864 S 6/2015 Clouse
D732,941 S 6/2015 Erickson
D733,431 S 7/2015 Kokenge
9,130,326 B2 9/2015 Meis
9,131,771 B2 9/2015 Lindblom
D761,236 S 7/2016 Wengreen
D766,634 S 9/2016 Nilsson
9,476,441 B2 10/2016 Strassle
D770,206 S 11/2016 Nilsson
D784,745 S 4/2017 Nilsson
D785,605 S 5/2017 Hochman
D789,718 S 6/2017 Gokhale
9,743,762 B1 8/2017 Beuses
9,770,122 B2 9/2017 Gonzalez
D800,185 S 10/2017 Onrat
D801,094 S 10/2017 Verna
D808,697 S 1/2018 Heckler
D809,672 S 2/2018 Brennan
10,012,255 B2 7/2018 Knutson
10,016,057 B1 7/2018 Arnautovic
D828,744 S 9/2018 Bright
D839,029 S 1/2019 Nilsson
D843,149 S 3/2019 Nilsson
D869,195 S 12/2019 Nilsson
10,602,843 B2 3/2020 Sisto
D882,290 S 4/2020 Nilsson
10,634,279 B2 4/2020 Lu
10,653,239 B2 * 5/2020 Nilsson ..... A47B 96/028
D927,292 S 8/2021 Zussman
11,229,287 B2 1/2022 Nilsson
11,253,069 B2 * 2/2022 Kokenge ..... F16B 21/00
11,369,215 B2 * 6/2022 Obitts ..... A47B 96/07
11,375,812 B2 7/2022 Nilsson
11,717,085 B2 * 8/2023 Nilsson ..... A47B 96/1408
211/182
2002/0043914 A1 4/2002 Munday
2004/0007550 A1 * 1/2004 Leeman ..... A47F 5/101
211/187
2005/0006541 A1 1/2005 Magnusson
2005/0011844 A1 1/2005 Magnusson
2005/0056604 A1 3/2005 Chen
2005/0109720 A1 5/2005 Marchetta
2005/0109901 A1 5/2005 Stitchick
2005/0145588 A1 7/2005 Stitchick
2005/0150436 A1 7/2005 Marchetta
2005/0150850 A1 7/2005 Stitchick
2005/0160691 A1 7/2005 Kim
2007/0023375 A1 2/2007 Fedewa
2007/0221595 A1 9/2007 Chen
2007/0221597 A1 9/2007 Chen
2008/0116329 A1 5/2008 Magnusson
2008/0142669 A1 6/2008 Zlotocha
2008/0173778 A1 7/2008 Mertens
2008/0237426 A1 * 10/2008 Walters ..... H04N 5/64
248/304
2009/0139943 A1 6/2009 Fernandez
2009/0242497 A1 10/2009 Nilsson
2010/0001159 A1 1/2010 Kao
2010/0300999 A1 12/2010 Schwartzkopf
2011/0042333 A1 2/2011 Magnusson
2011/0219706 A1 9/2011 Bates
2012/0255925 A1 10/2012 Fernandez
2013/0199099 A1 8/2013 Lars
2014/0138332 A1 5/2014 Loree
2015/0076983 A1 3/2015 Lindblom
2015/0152904 A1 6/2015 Nilsson
2015/0296982 A1 10/2015 Chen
2015/0335155 A1 11/2015 Winker
2016/0227944 A1 8/2016 Gonzalez
2016/0316939 A1 11/2016 Kraiss
2017/0112282 A1 4/2017 Will
2017/0119150 A1 5/2017 Andersson
2017/0311717 A1 11/2017 Nilsson
2018/0132610 A1 * 5/2018 Lu ..... A47B 57/42

(56) References Cited

U.S. PATENT DOCUMENTS

| | | | |
|---|---|---|---|
| 2018/0132611 | A1 | 5/2018 | Lu |
| 2018/0135796 | A1 | 5/2018 | Lu |
| 2018/0352953 | A1 | 12/2018 | Nilsson |
| 2019/0387902 | A1 | 12/2019 | Peck |
| 2020/0113329 | A1 | 4/2020 | Nilsson |
| 2020/0187675 | A1 | 6/2020 | Obitts |
| 2020/0288866 | A1 | 9/2020 | Richard |
| 2020/0323340 | A1 | 10/2020 | Nilsson |
| 2021/0337966 | A1 | 11/2021 | Nilsson |
| 2021/0337967 | A1 | 11/2021 | Nilsson |
| 2022/0047071 | A1 | 2/2022 | Nilsson |

FOREIGN PATENT DOCUMENTS

| | | | |
|---|---|---|---|
| CN | 201782324 | U | 4/2011 |
| CN | 102113777 | A | 7/2011 |
| CN | 203572135 | U | 4/2014 |
| CN | 104145535 | A | 11/2014 |
| CN | 203934885 | U | 11/2014 |
| CN | 205813984 | U | 12/2016 |
| CN | 207621131 | U | 7/2018 |
| DE | 10020772 | C1 | 1/2002 |
| EP | 1656049 | A1 | 5/2006 |
| EP | 2090197 | A1 | 8/2009 |
| EP | 2372064 | A1 | 10/2011 |
| ES | 233096 | U | 3/1978 |
| GB | 803789 | A | 10/1958 |
| GB | 1503214 | A | 3/1978 |
| GB | 2169791 | | 7/1986 |
| GB | 2284745 | A | 6/1995 |
| JP | S4618350 | Y | 6/1971 |
| JP | S51123123 | U | 10/1976 |
| JP | H0965957 | A | 3/1997 |
| JP | 2002051852 | A | 2/2002 |
| JP | 2010269078 | A | 12/2010 |
| JP | 2011072551 | | 4/2011 |
| RU | 2082307 | C1 | 6/1997 |
| RU | 8571 | U1 | 12/1998 |
| RU | 30249 | U1 | 6/2003 |
| RU | 80099 | U1 | 1/2009 |
| RU | 2014123979 | A | 12/2015 |
| RU | 2579735 | C2 | 4/2016 |
| SE | 504960 | C2 | 6/1997 |
| SE | 544174 | C2 | 2/2022 |
| WO | 9216126 | | 10/1992 |
| WO | 9424440 | | 10/1994 |
| WO | 1994024440 | A1 | 10/1994 |
| WO | 9427474 | | 12/1994 |
| WO | 1994027474 | A1 | 12/1994 |
| WO | 2004056236 | | 7/2004 |
| WO | 2008060221 | A2 | 5/2008 |
| WO | 2013071977 | A1 | 5/2013 |
| WO | 2013191624 | A1 | 12/2013 |
| WO | 2015050868 | | 4/2015 |
| WO | 2015050868 | A1 | 4/2015 |
| WO | 2015189142 | A1 | 12/2015 |
| WO | 2016077717 | A1 | 5/2016 |
| WO | 2016176915 | A1 | 11/2016 |
| WO | 2019069284 | A1 | 4/2019 |
| WO | 2019083632 | A1 | 5/2019 |
| WO | 2020055438 | A1 | 3/2020 |
| WO | 2021061683 | A1 | 4/2021 |
| WO | 2021133240 | A1 | 7/2021 |

OTHER PUBLICATIONS

Elfa Creating Space, Product List 2019/20 Interior, 940983, Ver. 1, Jan. 2020, 84 pages.
Elfa, Product List, Ver. 1, Oct. 2016, 32 pages.
Extended European Search Report issued in corresponding European Application 18770260.0, mailed Aug. 20, 2020.
Extended European Search Report issued in corresponding European Application No. 18870845.7, mailed Jul. 5, 2021.
Final Office Action issued in corresponding U.S. Appl. No. 16/759,727, mailed Aug. 18, 2021.
First Office Action issued in corresponding Chinese Application No. CN201880020114.9, mailed Jan. 19, 2021.
International Search Report and Written Opinion for International Patent Application PCT/SE2021/050395 Mailed May 14, 2021.
International Search Report and Written Opinion from PCT/SE2021/050396 mailed May 19, 2021.
International Search Report and Written Opinion received in Patent Cooperation Treaty Application No. PCT/US2018/050781, dated Feb. 14, 2019.
International Search Report and Written Opinion received in Patent Cooperation Treaty Application No. PCT/SE2020/051246, dated Feb. 15, 2021.
International Search Report issued in Application No. PCT/US2018/058598, mailed May 30, 2019.
International Search Report issued in corresponding Application No. PCT/US2018/050781, mailed Feb. 14, 2019.
International Search Report PCT/SE2021/050396 dated May 19, 2021, 5 pages.
Non-Final Office Action issued in U.S. Appl. No. 16/569,644, mailed Sep. 21, 2021.
Office Action , Swedish Patent application No. 2050499-9 of Elfa International AB, dated Nov. 16, 2020, 5 pages.
Office Action (Final Rejection) dated Jul. 6, 2023 for U.S. Appl. No. 17/246,544 (pp. 1-13).
Office Action (Final Rejection) dated Jul. 11, 2023 for U.S. Appl. No. 17/246,544 (pp. 1-14).
Office Action (Final Rejection) dated Nov. 2, 2022 for U.S. Appl. No. 17/246,442 (pp. 1-19).
Office Action (Final Rejection) dated Dec. 6, 2022 for U.S. Appl. No. 17/246,544 (pp. 1-21).
Office Action (Non-Final Rejection) dated Apr. 27, 2022 for U.S. Appl. No. 17/246,544 (pp. 1-14).
Office Action (Non-Final Rejection) dated Jul. 22, 2022 for U.S. Appl. No. 17/246,442 (pp. 1-17).
Search report from SE 2050497-3 dated Nov. 25, 2020.
Search Report, Swedish Patent application No. 2050499-9 of Elfa International AB, dated Nov. 16, 2020, 2 pages.
Written Opinion issued in Application No. PCT/US2018/050781, mailed Feb. 14, 2019.
Written Opinion issued in Application No. PCT/US2018/058598, mailed May 30, 2019.
Written Opinion of the International Searching Authority PCT/SE2021/050396 dated May 19, 2021, 6 pages.

* cited by examiner

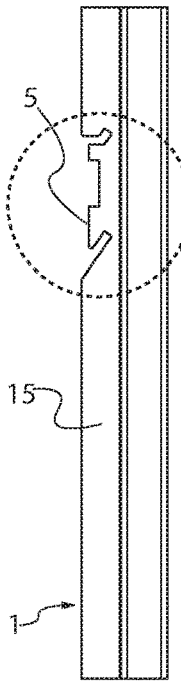
Fig 1A
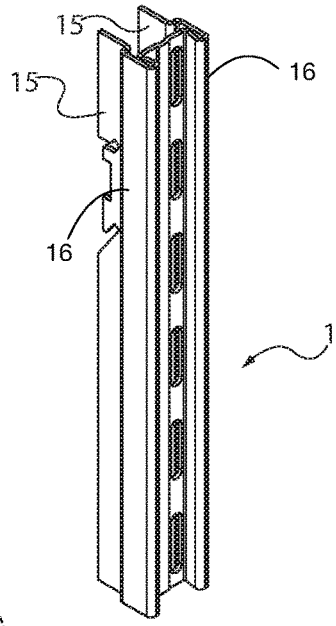
Fig 1B
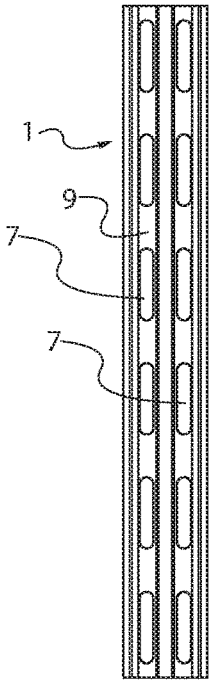
Fig 1C
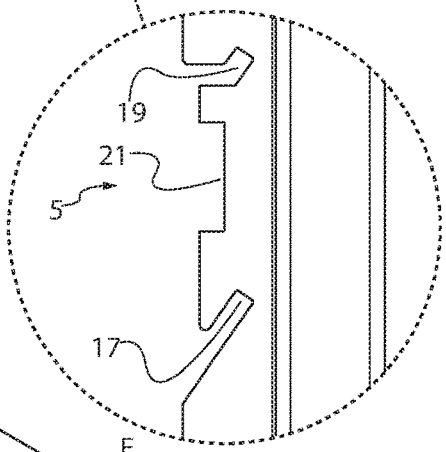
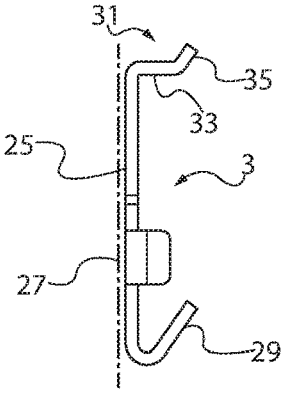
Fig 2B
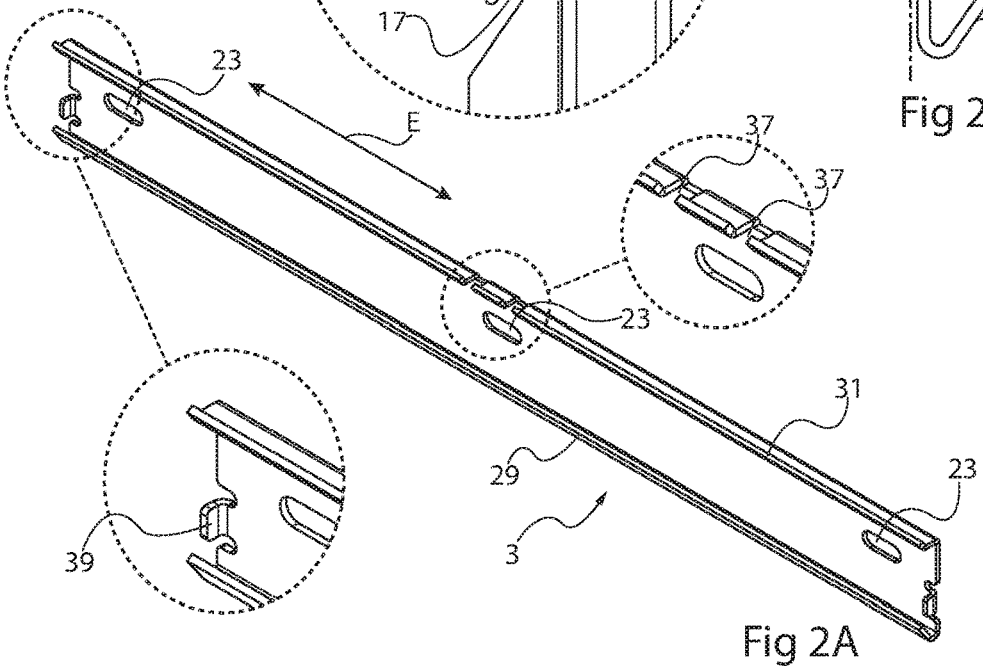
Fig 2A

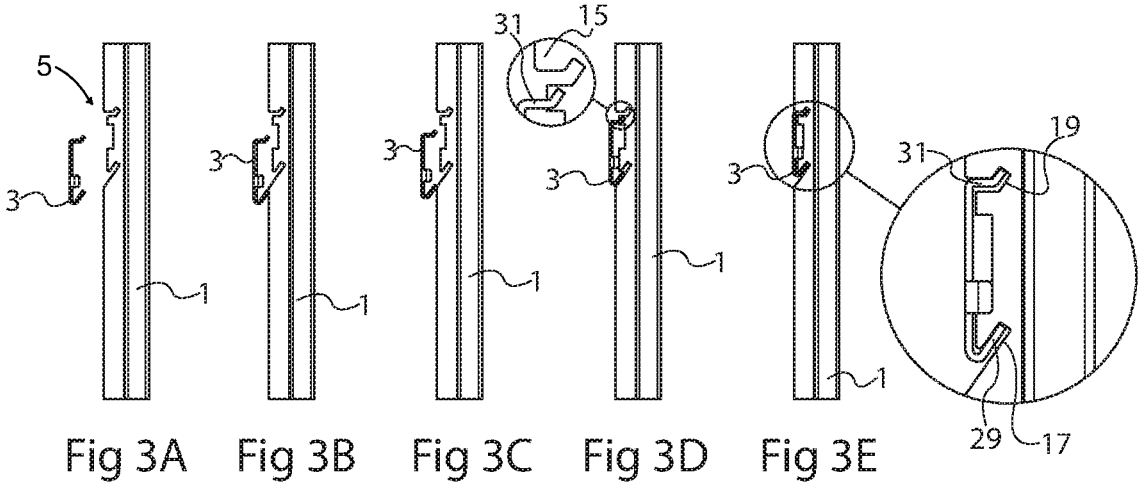
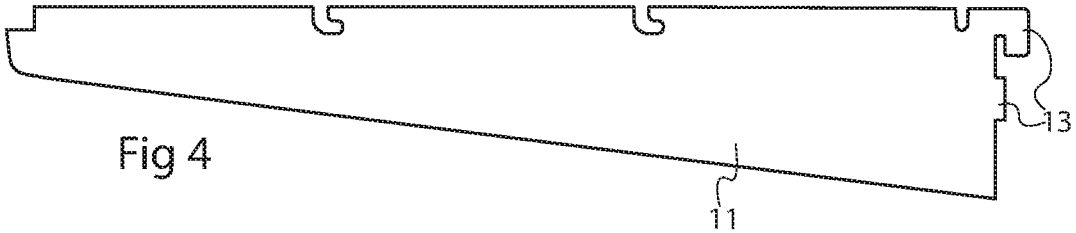
Fig 4
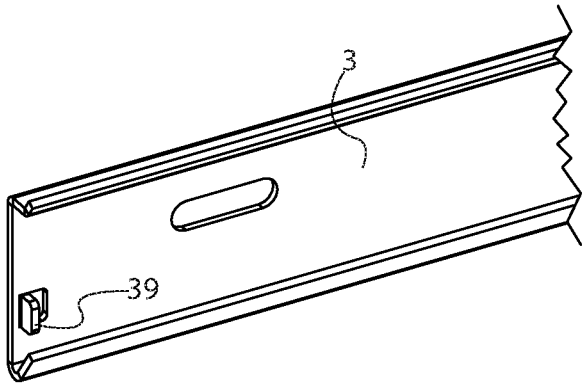
Fig 6
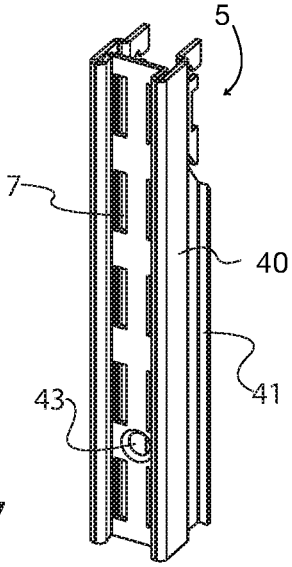
Fig 7

SUSPENSION SYSTEM FOR STORAGE COMPONENTS

This application is a divisional of U.S. application Ser. No. 17/246,442, filed Apr. 30, 2021, which claims priority to Swedish Patent Application No. 2051078-0, filed Sep. 16, 2020, and Swedish Patent Application No. 2050497-3, filed Apr. 30, 2020, all of which are incorporated by reference for all purposes.

FIELD OF INVENTION

The present disclosure relates to a suspension system for use with storage systems comprising vertically oriented hang standards arranged on a vertical surface, such as a wall or the like, connected to rear rail arranged horizontally on the vertical surface.

BACKGROUND

U.S. Pat. No. 5,110,080 discloses a suspension system comprising horizontally oriented rear rail or track for attachment to a wall or other vertical surface and hang standard is configured to be vertically arranged on the rail. The hang standard comprises a front portion with slots for connecting with cantilevered brackets and the like and rear leg portions arranged laterally with respect to the front portion and being configured to leave a space behind the front portion in front of the vertical surface. The rear track which is attached to a wall and includes a lower, upwardly bent edge forming a flange, with which a mounting slot in the rear of the hang standard engages, such that the hang standard becomes suspended from the rear track. The rear track also includes an upper bent edge which prevents that the hang standard becomes disengaged from the rear track in an involuntary manner, by abutting the hang standard end.

SUMMARY

The present disclosure relates to a suspension system that provides a hang standard to rear rail connection that improves the reliability of the connection. In a representative embodiment of such a suspension system a rear rail, when attached to a vertical surface, has a lower flange and an upper flange, each of which is bent out of the plane of the vertical surface and extends in a different direction relative to a plane of the vertical surface. A vertical hang standard with leg portions laterally extending from a front portion comprises a mounting slot adapted to connect with the lower and upper flanges of the rear rail. When the connected, the hang standard is cable of becoming firmly locked in connection with the rear rail.

BRIEF DESCRIPTION OF THE DRAWINGS

FIGS. 1A, 1B, and 1C show a side view, a perspective view and a front view of a hang standard according to an example of the present disclosure.

FIGS. 2A and 2B show a perspective view and a side view of a rear rail.

FIGS. 3A-3E illustrate side views of a hang standard being connected to a rear rail.

FIG. 4 shows a side view of a bracket.

FIG. 6 shows a rear rail with a modified end tab in accordance with an alternative example.

FIG. 7 illustrates a hang standard where the rear part is provided with outwardly extending flanges according to an alternative example.

DETAILED DESCRIPTION OF EXEMPLARY EMBODIMENTS

Figure 5A:
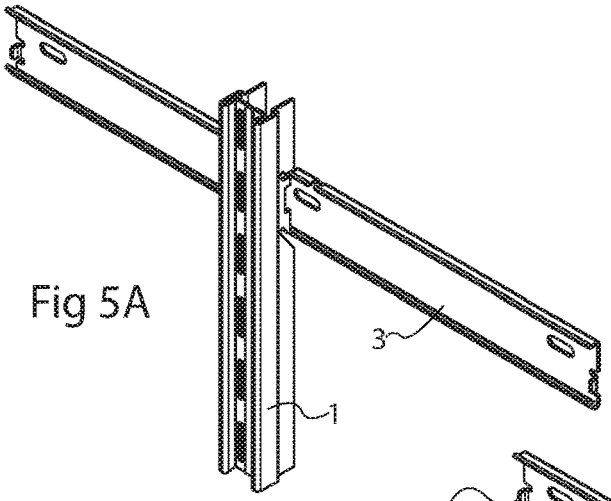
FIGS. 5A-5D show in perspective two hang standards being connected to a rear rail.

In the following description, like numbers refer to like elements.

The disclosure relates to a suspension system comprising a rear rail, configured to be arranged horizontally on a vertical surface, such as a wall or the like, the rear rail comprising a lower flange bent out of the plane of said vertical surface, and a hang standard, configured to be vertically arranged on said vertical surface and comprising a front portion having slots for connecting with cantilevered brackets and the like. The hang standard may, for example, have a U-shape with rear leg portions arranged laterally with respect to the front portion and being configured to leave a space behind the front portion in front of the vertical surface. The hang standard comprises a suspension slot arranged in each of the leg portions, the suspension slots being configured to connect with the lower flange of the rear rail to suspend the hang standard from the rear rail.

In the embodiments disclosed below of a suspension with an improved connection between a hang standard and a rail, the rear rail further has an upper flange bent out of the plane of the vertical surface. Each leg portion of the hang standard further comprises a mounting slot adapted to connect with the upper flange of the rear rail, and the upper and lower flanges at least partially extend in different directions. This means that the hang standard may become firmly locked in connection with the rear rail once installed. The embodiments disclosed below are representative, non-limiting examples with multiple, optional features that provide additional benefits and advantages.

Both the lower and upper flanges may, for example, be directed obliquely upwards, such that they can both contribute to carrying the load of the hang standard. In alternate embodiments, only one of them is oriented upwardly.

Furthermore, the upper flange may, for example, comprise multiple portions—an inner portion and an outer portion, for example—which are differently angled with respect to the plane of the vertical surface. With this optional feature, the hang standard locks to the rear rail even more reliably.

The rear rail may also comprise one or more cut-outs in the upper flange providing an entry point for the hang standard between the ends of the rail. With this optional feature, the hang standards need not be applied from the end of the rear rail and can be attached thereto at the middle of the rear rail, for instance. For example, the cut-outs may comprise first and second notches in the upper flange, which have the same mutual distance as the rear leg portions of the hang standard. In alternative embodiments, the cutout may be wide enough to accommodate the width of the hang standard. Thus, with this feature, the standard can be aligned with the one or more cutouts in a mounting flange that are located between the ends of the rail and hung on a support flange and then slid on the support flange to engage the mounting flange and to position the hang standard a desired location.

A stop may be provided at an end of the rear rail, such that an attached hang standard does not exit the rear rail at that end. This optional feature reduces the risk that the hang standard falls off at the end of the rear rail. The stop also enables an option to present a predetermined distance between hang standards by means of the rear rail. The stop may for instance be in the form of a tab, bent from the rear rail.

A recess may be provided in each of the rear leg portions in between the suspension slot and the mounting slot. This allows the hang standard to slide more freely sideways and provides room for wiring, etc.

An alternative embodiment of a suspension system comprises a rear rail, configured to be arranged horizontally on a vertical surface, such as a wall or the like, and a hang standard configured to be vertically arranged on the rail. The rear rail comprises a rear surface adapted to abut the vertical surface and a lower flange bent out of the plane of said rear surface to support the hang standard. The hang standard comprises a front portion having slots for connecting with cantilevered brackets and the like, and, in cross section, rear leg portions arranged laterally with respect to the front portion and being configured to leave a space behind the front portion in front of the vertical surface. The hang standard further comprises a suspension slot arranged in each of the leg portions, the suspension slots being configured to connect with the lower flange of the rear rail to suspend the hang standard therefrom. The rear rail comprises a stop at an end of the rear rail, such that an attached hang standard does not exit the rear rail at that end. The stop enables the rail to be made shorter without increasing the risk that the hang standard slips of the rail sideways, thereby saving material. Also, a predetermined hang standard to hang standard distance can be easily obtained. The stop may, for example, take the form of a tab bent from the rear rail and may be bent about an axis perpendicular to the elongated direction of the rear rail or parallel to that direction of the real rail. In the latter case, the tab may be bent from the lower flange of the rail.

In alternatives to the embodiments described above, an upper flange of a rail may be used as a support flange to engage a support slot of a hang standard. For suspensions systems with connections that include a mounting slot, a lower flange can be used to engage the mounting slot.

Referring now to the figures, illustrated are representative, non-limiting embodiments of a suspension system used for storage purposes, where vertically oriented hang standards are arranged on a vertical surface, such as a wall or the like. The hang standards have a U-shaped cross-section where in the mid-section include slots to which for instance cantilevered brackets can be attached. In turn, the brackets can carry shelves and other storage components.

FIGS. 1A, 1B, and 1C show a side view, a perspective view and a front view, respectively, of an elongated hang standard 1. As best seen in FIG. 1C, the hang standard 1 comprises one or more columns—in this example, two columns—of elongated slots 7 in a front portion 9 thereof for connecting with connecting means 13 of, for example. a cantilevered bracket 11 like the one illustrated in FIG. 4.

As best seen in FIG. 1B, the hang standard 1 further has, in cross-section, two leg portions 15, extending backwards on either side of the front portion 9. The front portion and the leg portions 15 together form a U-shaped cross section. In order to strengthen the hang standard 1, typically by increasing its bending stiffness, there may be provided forward-projecting protrusions 16 at the transitions between the backward extending leg portions 15 and the front portion 9, such that the cross section becomes H-shaped. The hang standard 1 can be made from a single strip of sheet metal that is punched and bent into this shape. The forward extending protrusions The rear portion of the hang standard 1 comprises a connector 5 for connecting with a rear rail as will be described. As shown in the enlarged portion of FIG. 1A, the connector 5 includes a lower suspension slot 17, which is cut in each of the backwards extending leg portions 15 and is directed obliquely upwards. There is further provided a mounting slot 19 and optionally a recess 21. The mounting slot 19, as shown, may have two portions oriented slightly differently.

FIG. 2A shows a perspective view of an elongated rear rail 3 which is configured to connect with the hang standard 1. At the same time, it is referred to FIG. 2B, illustrating a side view of the rear rail 3. The rear rail 3 may be made from a single strip of sheet metal and may comprise screw holes 23 to allow the rear rail 3 to be fastened to a vertical surface such as a wall or similar. The screw holes 23 may be elongated to allow some tolerances when making holes for the screws in the vertical surface. As best seen in FIG. 2B, the rear rail 3 may comprise a rear surface 25, which is configured to abut the vertical surface. The rear surface 25 may be flat, as shown, although this is not necessary. However, the rear surface 25 generally extends in a vertical plane 27, parallel to the one indicated by the dash-dot line of FIG. 2B, which plane 27 will also coincide with the vertical surface.

The rear rail 3 comprises a lower flange 29 which is bent out of the plane 27 of the rear surface 25, more than 90 degrees, such that the lower edge of the strip making up the rear rail 3 is directed obliquely upwards in an angle corresponding to the one of the hang standard's 1 suspension slot 17. Thereby, the rear rail 3 becomes capable of suspending the hang standard 1. The upper edge of the strip making up the rear rail 3 is as well bent out of the plane 27 of the rear surface 25 forming an upper flange 31 and being bent as well in the direction towards the hang standard 1. As shown, the upper flange 31 can have two differently angled portions 33, 35. In principle, the lower flange could also be configured in this way, but, if so, the upper flange 31 should be straight. At least partially, the upper 29 and lower 31 flanges may extend in slightly different directions. Either should be configured to at least partly extend upwards when the rear rail 3 is attached to a wall to be able to suspend a hang standard 1 as will be discussed.

The profiles of the suspension slot and mounting slot thus complement or match the profiles of the corresponding flanges. Additionally, the profiles of the flanges on the rail allow for one of them or, optionally, both of them to be inserted into corresponding slots on the standard from the front of the rail, but not both at the same time. For reasons to be discussed, the profile of the support flange in the illustrated embodiments, which is used to suspend the hang standard during at least the connecting or mounting process, allows the flange to be inserted into the support slot from the front of the rail, generally in a downward direction. It can also be moved laterally on the rail, and thus the support flange can also be inserted into the support slot from the end of the rail. In the example that is shown, the profiles of the mounting flange and the mounting slot allow only mounting in a lateral direction when the support flange is inserted into the support slot. In other words, the mounting flange cannot be easily inserted into or removed from the mounting slot from the front of the rail at the same time the support flange is being inserted into or removed from the support slot. In this embodiment, the hang standard can be connected to both the support and mounting flanges by sliding it laterally or horizontally onto an end of the rail, where the profiles of both flanges match the profiles of both slots. The mounting flange may have a single, matching section or portion that is angled or shaped differently—curved, for example—than that of the support flange with respect to the rear surface of the rail. The mounting flange may also have multiple portions, such as flange bent into to have two or more straight segments, at least two of which have a different angle with respect to the rear surface. One or more of the multiple portions may be curved.

The configuration of the suspension slot 17 and the mounting slot 19 on the one hand, and the lower flange 29 and the upper flange 31 on the other, match in such a way that the hang standard 1 can be attached to and slide on the rear rail 3. At the same time, the hang standard 1 becomes locked to the rear rail 3 in such a way that it does not fall off the wall or the like, and can reliably carry heavy loads, for instance in the form of brackets with associated shelves and goods stored thereon. Also, the double slots 17, 19 and flanges 29, 31 prevent that the hang standard swings in the plane of the wall or the like, especially if the upper flange 31 has a portion that projects more or less horizontally from the plane 27 of the rear surface. In the illustrated example, portion 33 is perpendicular with rear surface 25.

If the rear rail 3 has a uniform cross section along its length, it would be possible to connect the hang standard 1 to the rear rail by threading the upper and lower flanges 31, 29 into the mounting slot 19 and the suspension slot 17, respectively, at the end of the rear rail 3. While this may be considered in a basic form of the suspension system, this disclosure proposes a further developed solution as illustrated in FIG. 2A. At some point along the rear rail 3, in the illustrated case at the mid-point, there is provided cut notches 37 or openings in the upper flange 31. In the shown case, the distance between these notches 37 corresponds to the mutual distance between the leg portions 15 of the hang standard 1. However, it would also be possible to provide a single notch, which is as wide or somewhat wider than the width of the hang standard 1.

At these notches 37, the hang standard 1 can be easily connected to the rear rail 3 as will be described with reference to FIGS. 3A-3E illustrating side views of a hang standard 1 being connected to a rear rail 3. As the hang standard 1 is attached at the notches 37, the lower flange 29 can be slid into the suspension slot 17 while the leg portions 15 of the hang standard 1, as best seen in the enlarged portion of FIG. 3D, pass by the upper flange 31 in the notches 37 until the mounting slot 19 is aligned with the upper flange 31 and the lower flange 29 is fully inserted in the suspension slot 17, as best seen in the enlarged portion of FIG. 3E. In this position, the rear rail 3 is fully inserted in the hang standard 1, such that the rear edges of the hang standard leg portions 15 are aligned with the rear surface 25 of the rear rail 3. This means that the hang standard 1 may rest against the wall 27 or some other vertical surface (see FIG. 2B) in addition to being suspended from the rear rail 3, which gives a stable suspension where the hang standard 1 is not prone to swing.

Figure 5B:
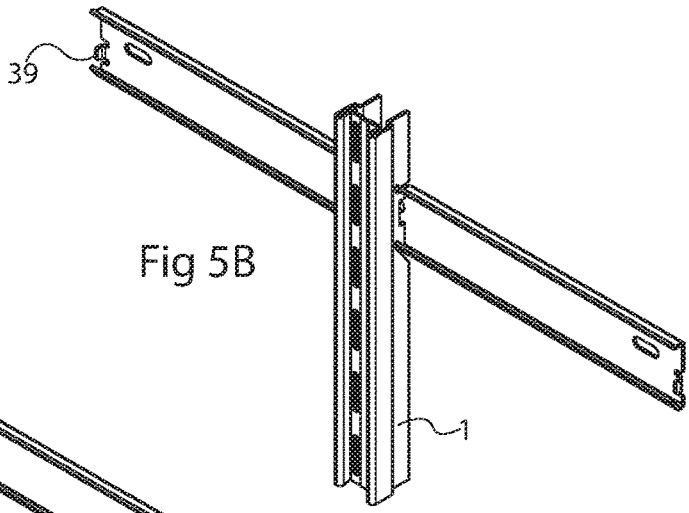
Figure 5C:
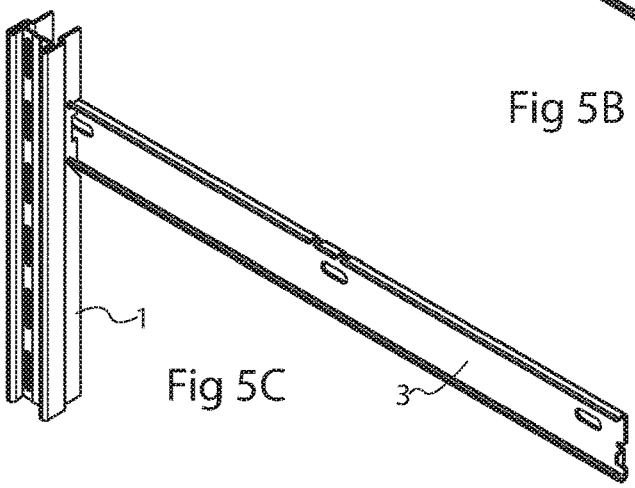

FIGS. 5A and 5B show in a perspective view a hang standard 1 being connected to a rear rail 3 as previously described in connection with FIGS. 3A-3E. Then, the hang standard 1 may be slid to the right on the rear rail 3 and, when thereby being removed from the location of the notches 37, becomes firmly connected to the rear rail 3. The hang standard 1 can be slid until reaching an end tab 39, best shown in an enlarged portion of FIG. 2A, to reach the position in FIG. 5C.

As shown, for example, in the enlarged portion of FIG. 1A there may be provided a recess 21 in each rear leg portion 15 of the hang standard, in between the suspension slot 17 and the mounting slot 19. This allows the hang standard to pass by heads of screws (not shown) used to attach the rear rail 3 to a wall or the like. The recesses 21 may also provide space to run, for example, for wiring, for instance for lighting purposes.

Figure 5D:
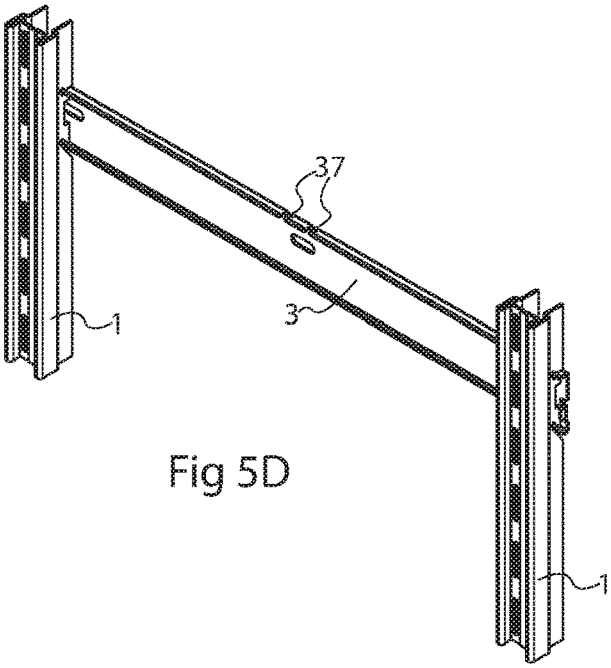

Then, a second hang standard 1 can be attached in the same way at the notches and be slid to the right until reaching an opposing end tab 39 as shown in FIG. 5D. This allows a user to readily position the hang standards 1 at a predetermined desired mutual distance which is suitable for instance for a shelf or drawer system to be connected to the hang standards.

FIG. 6 shows a rear rail with a modified end tab 39 in accordance with an alternative example. In this example, a curved slit is punched from the rear rail 3 a short distance from the end thereof, and a tab 39 is bent out of the main plane of the rear rail 3, which retains a straight short edge. This saves some material when the rear rail 3 is produced.

Stops such as the above indicated end tabs can be advantageous to use in other types of suspension systems with rear rails and hang standards as will be discussed. The stops reduce the need for significant margins—lengths of rail—at the sides of the hang standard, allowing for a shorter rail than in known systems without risking that the hang standard slips off. This saves material and hence costs.

FIG. 7. illustrates an example of an alternative hang standard 40, which is similar to hang standard 1 but has a rear leg 15 provided with outwardly extending flanges 41. Providing such flanges increases the second moment of area of the hang standard as compared to hang standard 1 such that it becomes stiffer. Making the standard stiffer reduces the tendency of the hang standard to bend away from the wall or the like if loaded heavily by a cantilevered bracket. The flanges 41 may extend along the length of the hang standard. But to facilitate connecting the hang standard to the rear rail 3, typically the flanges 41 do not extend from the rear legs 15 where it is connected to the rail, at the connector 5, as illustrated FIG. 7.

As illustrated, a hang standard 1 may also be provided with screw holes 43 at one or more locations along its length to provide complementing or alternative ways of attaching the hang standard 1 to a wall, if desired.

As also illustrated in FIG. 7, it is possible to provide the hang standard 1 with rectangular slots 7, which may enhance the load distribution, avoiding that the end of the slot is deformed.

Figure 8:
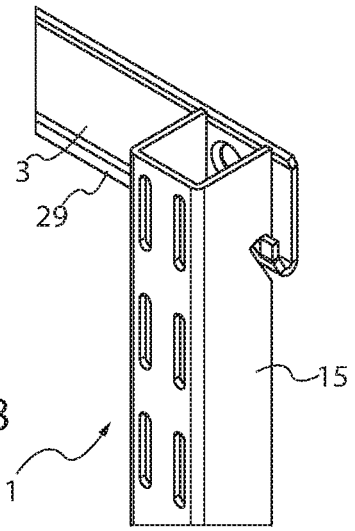
FIG. 8 illustrates a suspension system comprising a rear rail, from which a vertical standard is hanging, with end stops.

As mentioned, stops such as the above indicated end tabs can be generally useful in suspension systems with rear rails and hang standards as will be discussed. This is thus not limited to cases where two slots are provided in each leg portion of the hang standards. For instance, the stop can also be provided in a suspension system, as disclosed in U.S. Pat. No. 5,110,080-A or similar to what is illustrated with an example shown in FIGS. 8-11. FIG. 8 shows a hang standard 1 attached to such a rear rail 3, the latter being shown in a side view in FIG. 9 and in a perspective view in FIG. 10.

Generally, a suspension system is considered with a rear rail 3, having a lower flange 29 bent out of the plane of rear surface, and a hang standard 1, configured to be vertically arranged and having rear leg portions 15 arranged laterally with regard to a front portion 9 wherein the hang standard comprises a suspension slot 17 arranged in each of the leg portions 15, for connecting with the lower flange 29 of the rear rail 3. The rear rail 3 has a stop 45 at an end of the rear rail, such that an attached hang standard does not exit the rear rail 3 at that end. As shown, this feature can be applied also in otherwise known systems. Double rear slots are not necessary as the hang standards can be prevented from leave the lower flange 29 for instance by being screwed to a wall, such as through a screw hole (not shown) in the hang standard 1.

Although the stops in the illustrated examples are in the form of a tabs 39 and 45 bent from the rear rail 3, it would be possible for instance to provide a stop in the form of a bead welded in the rail 3 or a screw, for instance.

Figure 9:
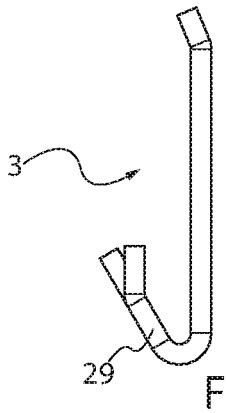
FIG. 9 illustrates an end view of the rear rail shown in FIG. 8 without the vertical standard.
Figure 10:
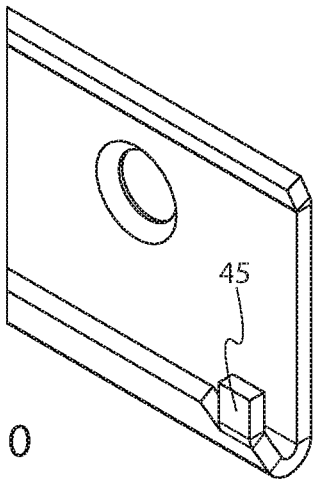
FIG. 10 illustrates a perspective view of the rear rail without the vertical standard shown in FIG. 9.
Figure 11:
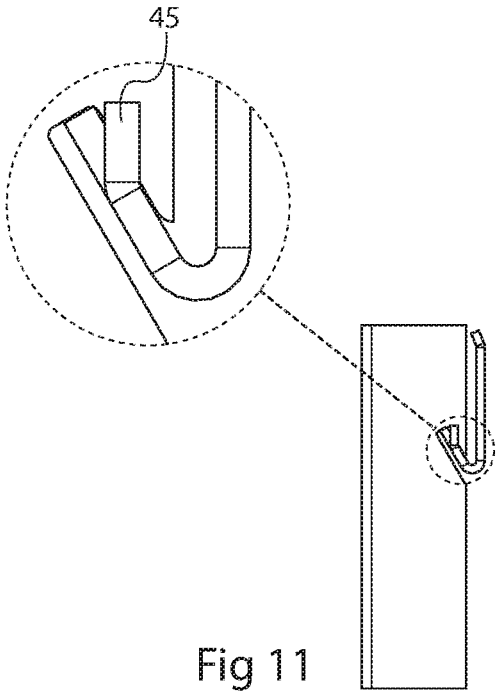
FIG. 11 illustrates a side, end view of the rear rail and vertical standard of FIG. 8.

As shown in FIG. 2A, the tab 39 may bent about an axis perpendicular to the elongated direction E of the real rail 3. As shown in FIG. 9, the tab 45 may also be bent about an axis parallel to the elongated direction of the rear rail 3, in the illustrated case bent from the lower flange 29.

The present disclosure is not restricted to the examples given above and may be varied and altered in different ways within the scope of the appended claims. For instance, the hang standard shown for illustrative purposes is very short, just having five or six slots in each row. In a more usual configuration, the hang standard has several tens of slots.

The foregoing description is of exemplary and preferred embodiments. The invention, as defined by the appended claims, is not limited to the described embodiments. The embodiments are, unless otherwise noted, non-limiting examples of one or more inventive features. Alterations and modifications to the disclosed embodiments may be made without departing from the invention. The meaning of the terms used in this specification are, unless stated otherwise, intended to have their ordinary and customary meaning to those in the art and are not intended to be limited to specific implementations that may be described.

What is claimed is:

1. A suspension system comprising rear rail elongated in a direction of elongation, configured to be arranged horizontally on a vertical surface, the rear rail comprising a rear surface adapted to abut said vertical surface and a suspension flange bent out of a plane defined by said rear surface from an end of the rear rail along at least part of its length, and a hang standard configured to be vertically arranged and comprising a front portion having slots for connecting with cantilevered brackets, and, in cross section, rear leg portions arranged laterally with regard to the front portion and being configured to leave a space behind the front portion, in front of the vertical surface, wherein the hang standard further comprises a suspension slot arranged in each of the rear leg portions, the suspension slot being configured to connect with the suspension flange of the rear rail to suspend the hang standard from the rear rail while permitting the hang standard to slide on the suspension flange toward the end of the rear rail, and wherein the rear rail comprises a stop at the end of the rear rail that is arranged to prevent the hang standard from sliding on the suspension flange past the end of the rear rail;

wherein, the stop comprises a tab bent from the rear rail;

the tab is bent about an axis parallel to the direction of elongation of the rear rail; and the tab is bent from the suspension flange.

2. A rear rail for a suspension system of a wall-mounted storage system, the rear rail being elongated in a direction of elongation, the rear rail comprising a rear surface adapted to abut a vertical surface when horizontally mounted to the vertical surface and a suspension flange bent outwardly from the rear surface along a length of the rear rail starting from an end of the rear rail, and a stop arranged at the end of the rear rail;

wherein:

the suspension flange is configured to support hang standards that have a plurality of slots for connecting to cantilevered brackets and at least one suspension slot when the rear rail is mounted horizontally on the vertical surface and the suspension flange is inserted into the at least one suspension slot;

the rear rail is configured for the hang standard to be slidable along the rear rail when the suspension flange is received within the at least one suspension slot;

the stop is configured to interfere with further sliding of the hang standard on the suspension flange such that it does not slide off the end of the rear rail;

the stop comprises a tab bent from the rear rail; and the tab is bent from the suspension flange.

3. The rear rail for a suspension system of a wall-mounted storage system according to claim 2, wherein the tab is bent about an axis parallel to the direction of elongation of the rear rail.

4. The rear rail for a suspension system of a wall-mounted storage system according to claim 3 in combination with a hang standard, the hang standard comprising a front portion having slots configured for connecting with cantilevered brackets and, in cross section, rear leg portions with suspensions slots, the rear leg portions being arranged laterally with regard to the front portion and configured to leave a space behind the front portion in front of the vertical surface.

* * * * *